US007784992B2

(12) United States Patent
Gustaveson

(10) Patent No.: US 7,784,992 B2
(45) Date of Patent: Aug. 31, 2010

(54) APPARATUS FOR A SOLAR WINDOW NIGHTLIGHT

(76) Inventor: Ron Gustaveson, 13172 S. Day Meadow Dr., Draper, UT (US) 84020

( * ) Notice: Subject to any disclaimer, the term of this patent is extended or adjusted under 35 U.S.C. 154(b) by 129 days.

(21) Appl. No.: 12/350,103

(22) Filed: Jan. 7, 2009

(65) Prior Publication Data

US 2010/0172128 A1 Jul. 8, 2010

(51) Int. Cl.
*H01R 33/00* (2006.01)

(52) U.S. Cl. ..... 362/641; 362/183; 362/125; 362/640

(58) Field of Classification Search ..... 362/125, 362/640, 641, 642, 646
See application file for complete search history.

(56) References Cited

U.S. PATENT DOCUMENTS

| | | | | |
|---|---|---|---|---|
| 5,181,745 | A * | 1/1993 | Jacobsen et al. | 283/94 |
| 5,618,100 | A * | 4/1997 | Glynn | 362/183 |
| 6,251,491 | B1 * | 6/2001 | Kim | 428/40.1 |
| 6,339,188 | B1 | 1/2002 | Voelkner | |
| 6,367,180 | B2 * | 4/2002 | Weiss et al. | 40/580 |
| 6,508,171 | B1 * | 1/2003 | Georges | 101/483 |
| 7,255,471 | B2 * | 8/2007 | Diorio et al. | 362/641 |
| 2002/0017045 | A1 * | 2/2002 | Weiss et al. | 40/580 |
| 2002/0112386 | A1 * | 8/2002 | Thomas | 40/554 |
| 2003/0081407 | A1 | 5/2003 | Bennett, Jr. | |
| 2003/0167947 | A1 * | 9/2003 | Lynn et al. | 101/424.2 |
| 2005/0103378 | A1 | 5/2005 | Pu | |
| 2006/0139912 | A1 * | 6/2006 | Norton et al. | 362/191 |
| 2006/0198128 | A1 * | 9/2006 | Piepgras et al. | 362/147 |
| 2009/0067180 | A1 * | 3/2009 | Tahmosybayat | 362/339 |
| 2009/0190367 | A1 * | 7/2009 | Chu | 362/487 |

* cited by examiner

*Primary Examiner*—Sandra L O'Shea
*Assistant Examiner*—Danielle Allen

(57) ABSTRACT

An apparatus for a solar window nightlight includes at least one battery contained within a circuit housing. Solar panels are disposed on an outside surface of the circuit housing for charging the battery. Control circuitry connects the battery, the solar panels and LED lights to control operations of the LED lights and charging of the at least one battery. A photocell is connected to the control circuitry where when ambient light falls below a predetermined level, the control circuitry activates the LED lights. Translucent lenses include a bore hole in a base for receiving one of the LED lights and reflective material on outside edges. Suction cups retain the apparatus on a window surface where, during day light hours, there is sufficient ambient light to charge the battery and, during night hours, the translucent lenses illuminate a desired area.

18 Claims, 3 Drawing Sheets

31
47
40
45

42
43
41
40
59
44
46
45
45
46
44

42
51
50
57
40
61
44
46
45
52
53
54
55
56
57
58
59
60

APPARATUS FOR A SOLAR WINDOW NIGHTLIGHT

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to solar lighting. More particularly, the invention relates to a solar window nightlight that includes a power source and projection lenses.

BACKGROUND OF THE INVENTION

There are several types of currently known nightlights that are typically plugged into a wall outlet. As these nightlights are usually plugged in, they constantly draw from the power grid. Therefore a nightlight that does not need to be plugged into a wall outlet is desirable. Other desirable features for a nightlight include without limitation, enabling the user to direct the light from the nightlight, providing decorative features, and providing various controls to the user such as, but not limited to, brightness control, color control, and speed of lighting.

In view of the foregoing, there is a need for improved techniques for providing nightlights may be powered without being plugged into a wall socket.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view; FIG. 1B is a rear perspective view; FIG. 1C is a side view, and FIG. 1D is a front perspective view of a lens separated from a circuit housing;

FIG. 2A is a rear view; FIG. 2B is a front view, and FIG. 2C is a front exploded view; FIG. 3A is a rear view; FIG. 3B is a front view; FIG. 3C is a side view, and FIG. 3D is a bottom view.

Figure 1C:
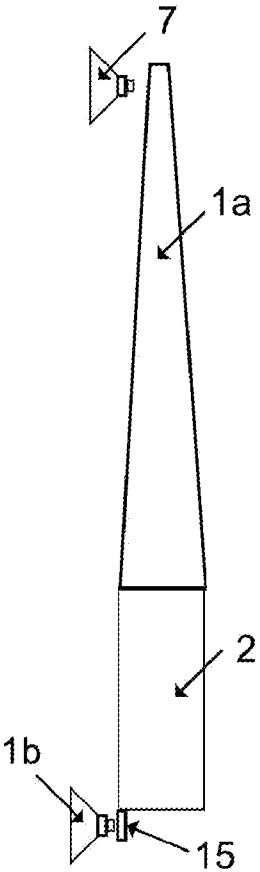
FIGS. 1A, 1B, 1C, and 1D illustrate an exemplary solar window nightlight, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for a solar window nightlight is presented.

In one embodiment, an apparatus for a solar window nightlight is presented. The apparatus includes a circuit housing. At least one battery is contained within the circuit housing. A plurality of solar panels are disposed on an outside surface of the circuit housing for charging the at least one battery. A plurality of LED lights are included. Control circuitry connects the at least one battery, the solar panels and the plurality of LED lights to control operations of the LED lights and charging of the at least one battery. A photocell is operative to detect ambient light. The photocell is connected to the control circuitry where when ambient light falls below a predetermined level, the control circuitry activates the plurality of LED lights. A plurality of translucent lenses each includes a generally wedge shape, a bore hole in a base of the wedge shape for receiving a one of the plurality of LED lights and reflective material on outside edges of the wedge shape to direct and contain light. A plurality of suction cups joined to at least the circuit housing retains the apparatus on a window surface where, during day light hours, there is sufficient ambient light to charge the at least one battery and the plurality of translucent lenses capture and reflect sunlight, and, during night hours, the translucent lenses illuminate a desired area.

In another embodiment an apparatus for a solar window nightlight is presented. The apparatus includes means for housing at least one battery and control circuitry, means for charging the at least one battery, means for producing light from the at least one battery, means for detecting a level of ambient light to activate the light producing means, means for lensing light from the light producing means and means for joining the apparatus to a window surface.

In another embodiment an apparatus for a solar window nightlight is presented. The apparatus includes a circuit housing. At least one battery is contained within the circuit housing. At least one solar panel is disposed on an outside surface of the circuit housing for charging the at least one battery. At least one light is included. Control circuitry connects the at least one battery, the at least one solar panel and the at least one light to control operations of the at least one light and charging of the at least one battery. A photocell is operative to detect ambient light. The photocell is connected to the control circuitry where when ambient light falls below a predetermined level, the control circuitry activates the at least one light. At least one translucent lens includes a bore hole for receiving the at least one light. Means retains the apparatus on a generally flat vertical surface where, during day light hours, there is sufficient ambient light to charge the at least one battery, and, during night hours, the translucent lens illuminates a desired area.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Preferred embodiments of the present invention provide a solar window nightlight that comprises a power source and projection lenses. Preferred embodiments use solar energy collected during the day to power the nightlight at night thus generally eliminating the need to constantly draw from the power grid. Some preferred embodiments may include a flexible conduit that separates the circuit housing from the projection lenses that enables the user to position the illuminated area. For example, without limitation, separating the two main components enables the user to thread the projection lenses through blinds or shutters and to select the exact position and direction of the lighting. Preferred embodiments may incorporate various types of designs such as, but not limited to, fish, animals, insects, flowers, machinery, letters, numbers, symbols, licensed material, etc. In addition, preferred embodiments may be used during the day to reflect light through translucent lenses like a sun catcher. In addition, preferred embodiments provide additional controls to the user such as, but not limited to, brightness control, color control, and speed of lighting.

One preferred embodiment of the present invention is an all-encompassed translucent print design that can be attached to a projection lens, as shown by way of example in FIGS. 1A through 1D. Another preferred embodiment is an all-encompassing inclusive design that has a decorative shape such as, but not limited to, a flower, an insect, an animal, machinery, a letter, a numeric, a symbol, a licensed design, etc., as shown by way of example in FIGS. 2A through 2C. Yet another preferred embodiment is a multi-component design that enables the user to position the illuminated components (i.e., the projection lenses) independently from the circuit housing via a flexible conduit, as shown by way of example in FIGS. 3A through 3D. In addition, multiple units of the same or different designs may be mixed and matched to make a larger picture or design. For example, without limitation, a spider may be created as a Halloween window night light decoration by taking one encompassed-inclusive design for the body and adding multiple multi-component designs for legs, etc.

Preferred embodiments are typically used by affixing the nightlight to a window via suction cups where the light captures sunlight during the day charging the internal batteries and reflecting light through translucent lenses. Once it becomes dark, the nightlight automatically activates the lighting source illuminating the desired area.

Figure 1B:
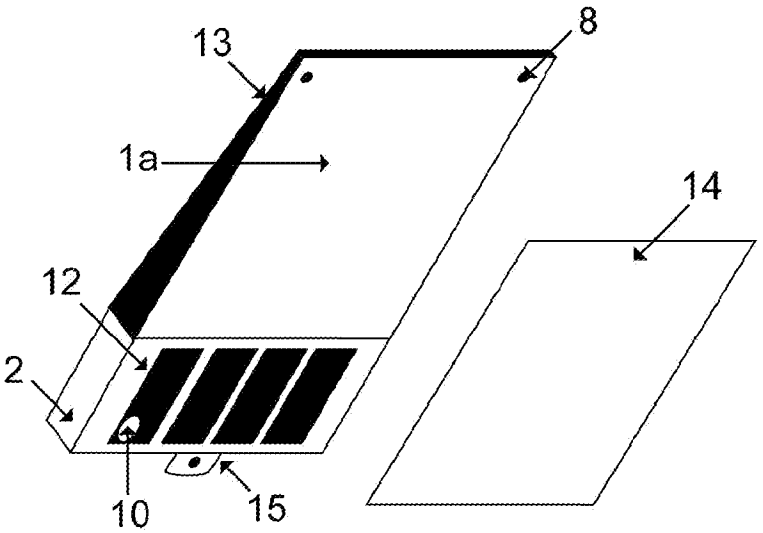
Figure 1D:
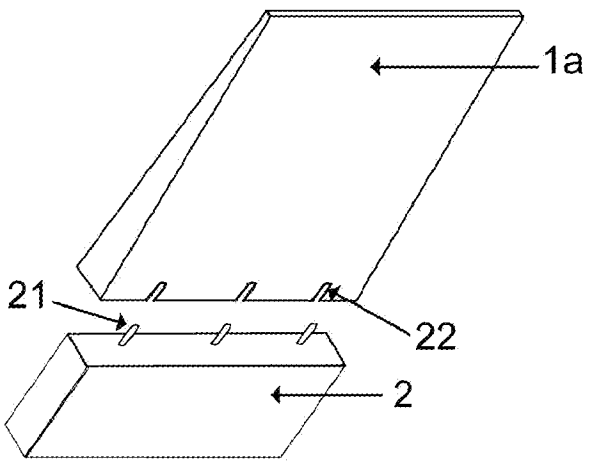
Figure 1A:
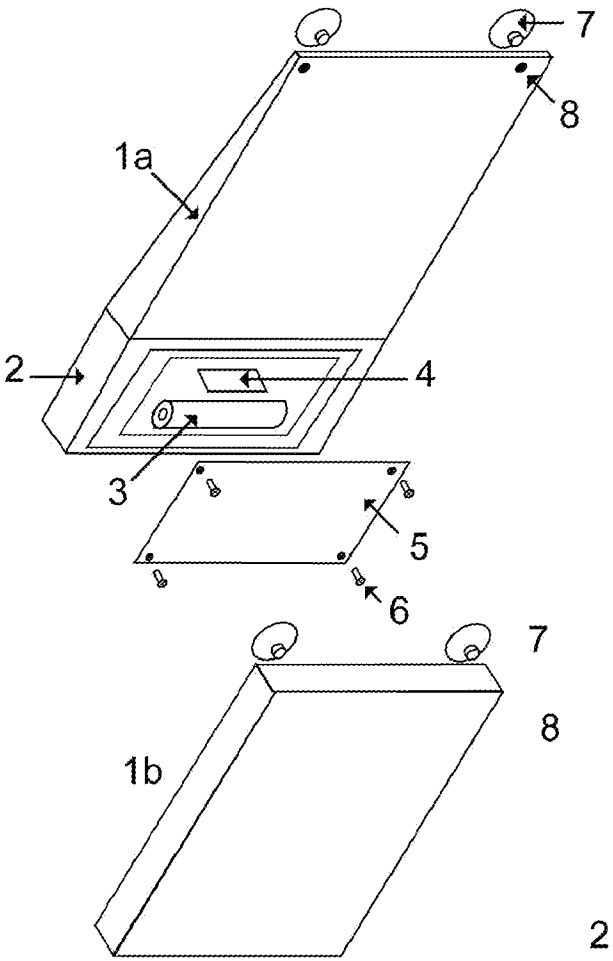

FIGS. 1A, 1B, 1C, and 1D illustrate an exemplary solar window nightlight, in accordance with an embodiment of the present invention. FIG. 1A is a front perspective view; FIG. 1B is a rear perspective view; FIG. 1C is a side view, and FIG. 1D is a front perspective view of a lens 1*a* separated from a circuit housing 2. In the present embodiment, the solar window nightlight comprises projection lens l*a* that is a translucent material such as, but not limited to, resin, plastic, or glass, which may have various shapes. Projection lens 1*a* is a wedge shape to provide more controlled lighting over a projection lens 1*b* that is rectangular in shape. Those skilled in the art, in light of the present teachings, will readily recognize that projection lenses in alternate embodiments may be various different shapes such as, but not limited to, circles, spheres, cubes, decorative shapes, etc. Both lenses 1*a* and 1*b* may be used as a sun capture to reflect light during the day. Projection lenses 1*a* and 1*b* can be solid material or hollow material depending on the light distribution desired. In the present embodiment, projection lens 1*a* is connected to circuit housing 2 that houses a rechargeable battery 3 and internal solar and lighting circuitry 4. Internal circuitry 4 is protected by a housing cap 5 that is secured to housing 2 with screws 6. The solar window nightlight also comprises suction cups 7, which are connected to projection lens 1*a* or 1*b* through holes 8.

Referring to FIG. 1B, the rear view of the solar window nightlight illustrates a photocell 10 and solar collection panels 12 on circuit housing 2. In the present embodiment, reflective tape 13 covers the outside edges of projection lens 1*a* to help direct and contain light; however, in alternate embodiments some solar window nightlights that do not need help directing and containing light do not include reflective tape on the projection lens. The solar window nightlight has the option to print designs on a transparent film 14 and use adhesive to apply film 14 to projection lens 1*a*. For additional support when attached to a surface, circuit housing 2 comprises an extra suction cup connection 15. Referring to FIG. 1C, a suction cup 16 is shown attached to suction cup connection 15. Referring to FIG. 1D, circuit housing 2 comprises LED light sources 21 that are powered by the solar collection circuitry, and projection lens 1*a* comprises bored LED inserts 22 into which LED light sources 21 are inserted when projection lens 1*a* is connected to circuit housing 2. LED light sources may be single or multiple colors and may be able to flash, alternate colors, or sparkle. In an alternate embodiment, the nightlight may comprise an additional cover to house a traditional incandescent light bulb.

In typical use of the present embodiment, the solar window nightlight is secured to a window with suction cups 7 and 16. Photocell 10 and solar collection panels 12 lie flat on the glass of the window charging rechargeable battery 3 any time there is light. In addition, projection lens 1*a* acts as a sun capture to reflect light during this time. Once it becomes dark, photocell 10 activates the LED light sources 21. If a design film 14 is attached to projection lens 1*a*, this design is now projected from projection lens 1*a* by LED light sources 21. In an alternate embodiment, the solar collection panels may be located on the front of the circuit housing so that the nightlight may be attached to a surface other than a window such as, but not limited to, a mirror, a wall, a piece of furniture, etc. and still collect light.

Figures 2A, 2B, 2C:
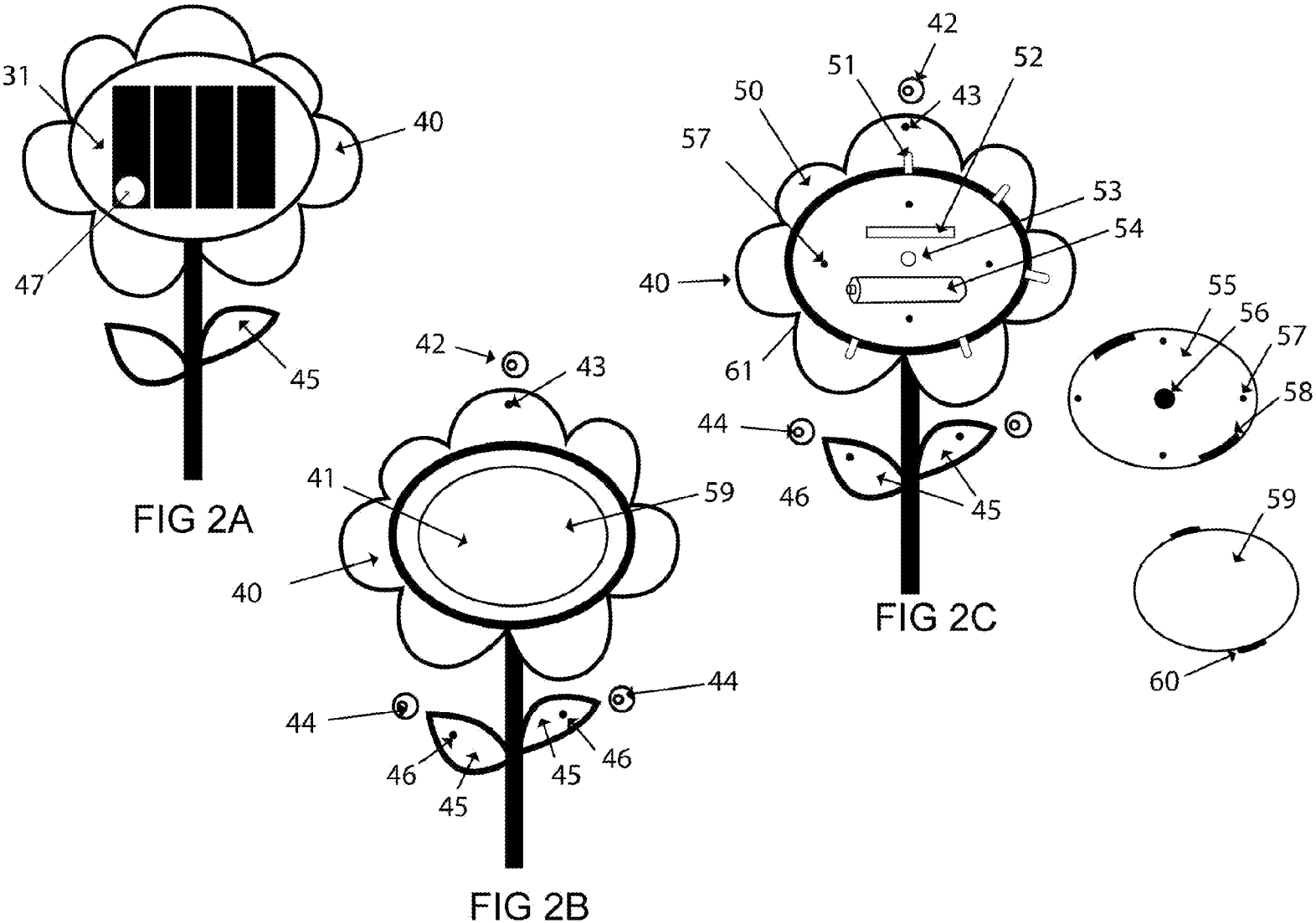
FIGS. 2A, 2B and 2C illustrate an exemplary nightlight where all of the components are built into a specific design, in accordance with an embodiment of the present invention.

FIGS. 2A, 2B and 2C illustrate an exemplary nightlight where all of the components are built into a specific design, in accordance with an embodiment of the present invention. FIG. 2A is a rear view; FIG. 2B is a front view, and FIG. 2C is a front exploded view. In the present embodiment, the nightlight is in the design of a flower; however, alternate embodiments may be various different designs such as, but not limited to, cars, stars, fish, animals, licensed designs, etc.

Referring to FIG. 2A, the back of the encompassed design is shown exposing solar collection panels 31 that lie flat on a window during use. Referring to FIG. 2B, the front of the encompassed design is shown illustrating petals 40 and a flower center 41, which act as projection lenses that illuminate once a photocell 47, is activated. The encompassed design is secured to a window by a suction cup 42 that is attached to a petal projection lens 40 through a hole 43 and suction cups 44 that are attached to decorative leaves 45 through holes 46.

Referring to FIG. 2C, the internal components of the encompassed design are illustrated. Petal projection lenses 40 each comprise a bored out hole 50 into which LED lights 51 are inserted. LED lights 51 can be single or multiple colors and may also be able to flash, alternate colors or sparkle. Inside a circuit housing 61 is lighting and solar collection circuitry 52, an additional LED light 53 that is threaded through a cutout 56 of a circuit-housing cap 55, and a power source 54, which is a rechargeable battery in the present embodiment. Circuit-housing cap 55 covers circuit housing 61 to protect and conceal internal circuitry 52 and is secured in place using screws threaded through secure points 57. In the present embodiment, circuit-housing cap 55 comprises cutouts 58 to secure a translucent lens 59 utilizing fittings 60 that thread though cutouts 58.

In typical use of the present embodiment, the nightlight is secured to a window using suction cups 42 and 44 with solar collection panels 31 facing the outside. Solar collection panels 31 lie flat on the glass of the window charging power source 54 any time there is light. In addition, petal projection lenses 40 act as sun captures to reflect light during this time. Once it becomes dark, the photocell activates LED light sources 51 and 53 to illuminate petals 40 and flower center 41. In an alternate embodiment, the solar collection panels may be located on the front of the circuit housing so that the nightlight may be attached to a surface other than a window such as, but not limited to, a mirror, a wall, a piece of furniture, etc. and still collect light.

Figure 3A:
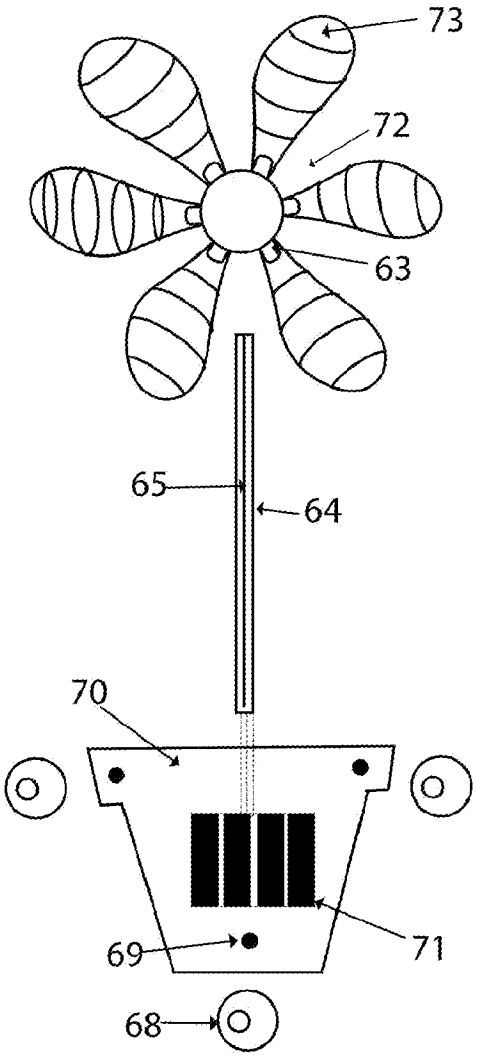
FIGS. 3A, 3B, 3C, and 3D illustrate an exemplary nightlight with a multi-part design, in accordance with an embodiment of the present invention.
Figure 3B:
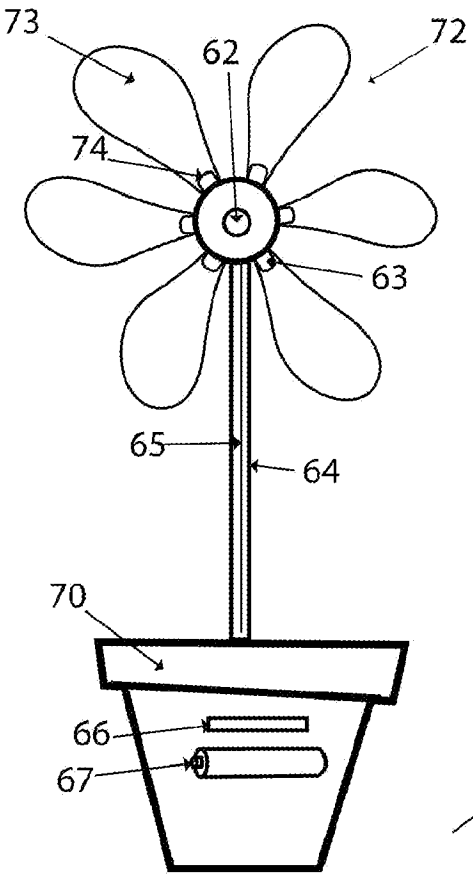
Figure 3C:
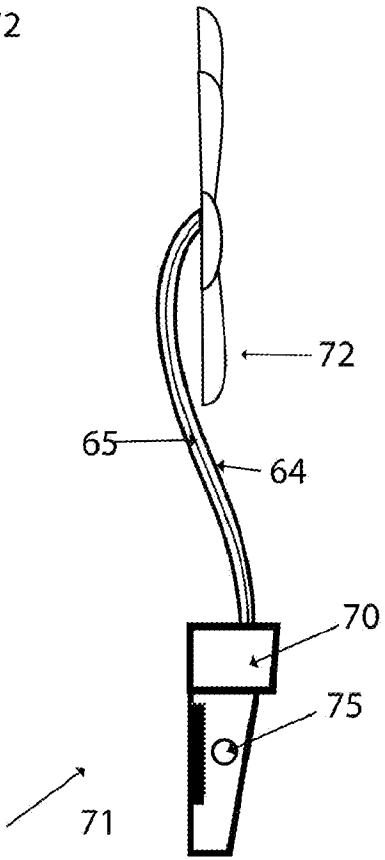
Figure 3D:
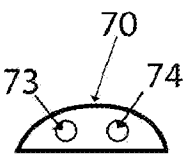

FIGS. 3A, 3B, 3C, and 3D illustrate an exemplary nightlight with a multi-part design, in accordance with an embodiment of the present invention. FIG. 3A is a rear view; FIG. 3B is a front view; FIG. 3C is a side view, and FIG. 3D is a bottom view. In the present embodiment, the nightlight is in the design of a flower; however, alternate embodiments may be various different designs such as, but not limited to, other plants, animals, insects, licensed designs, etc. In the present embodiment the nightlight comprises a circuit housing 70, a flexible conduit 64, and a projection lens assembly 72. In the present embodiment, projection lenses 73 are not part of circuit housing 70. Instead, wiring 65 from a power source 67 is housed in flexible conduit 64, which enables a user to position projection lens assembly 72 while maintaining the shaped integrity of flexible conduit 64. In the present embodiment, flexible conduit 64 is made of plastic that enables flexible conduit 64 to be shaped, bent and adjusted to direct the light of the nightlight; however, in alternate embodiments other materials may be used for the conduit, such as, but not limited to, a rubber hose that encases a metal wire.

Referring to FIG. 3A, the rear of the nightlight comprises solar collection panels 71 and suction cups 68, which fit into suction cup holes 69 in circuit housing 70. Referring to FIG. 3B, projection lenses 73 are connected to an additional lighting source 62 and comprise bored out holes 74 into which LED lights 63 are inserted. In the present embodiment, the same circuitry in the previously described embodiments is housed in circuit housing 70 including, but not limited to, lighting and solar collection circuitry 66 and power source 67.

Referring to FIG. 3C, the side view of the nightlight illustrates that flexible conduit 64 can be bent to position projection lens assembly 72. A photocell 75 on circuit housing 70 measures the amount of ambient light present. Referring to FIG. 3D a brightness dial 73 that controls the brightness of LED lights 63 and a speed control 74 that controls the speed of the rotation of LED lights 63 from slow sparkle to solid lights and everywhere in between are located on the bottom of circuit housing 70. Other controls that may be included in alternate embodiments include without limitation, a color rotation control when multiple color LED lights are included, a timer, or controls for effects such as, but not limited to, strobe, flash, sparkle, fade and on/off switch. LED lights 63 may be single or multiple colors and may also be able to flash, alternate colors or sparkle.

In typical use of the present embodiment, the nightlight is secured to a window using suctions cups 68 that are attached to circuit housing 70 with solar collection panels 71 lying flat against the window. Flexible conduit 64 can then be bent in any direction allowing for exact positioning of projection lens assembly 72. For example, without limitation, the user may position projection lens assembly 72 to light a doorway or to slide between slats in window blinds so that circuit housing 70 is attached to the window and projection lens assembly 72 is visible in the room. Solar collection panels 71 charge power source 67 any time there is light. Once it becomes dark, photocell 75 activates LED light sources 62 and 63 to illuminate projection lens assembly 72. In an alternate embodiment, the solar collection panels may be located on the front of the circuit housing so that the nightlight may be attached to a surface other than a window such as, but not limited to, a mirror, a wall, a piece of furniture, etc. and still collect light.

Having fully described at least one embodiment of the present invention, other equivalent or alternative methods of providing a solar nightlight according to the present invention will be apparent to those skilled in the art. The invention has been described above by way of illustration, and the specific embodiments disclosed are not intended to limit the invention to the particular forms disclosed. For example, the particular implementation of the light may vary depending upon the intended use. The embodiments described in the foregoing were directed to nightlight implementations; however, similar techniques are to implement embodiments of the present invention as different types of lights such as, but not limited to, reading lights, flashlights, accent lights, decorative lights, holiday lights, etc. Non-nightlight implementations of the present invention are contemplated as within the scope of the present invention. The invention is thus to cover all modifications, equivalents, and alternatives falling within the spirit and scope of the following claims.

What is claimed is:

1. An apparatus for a solar window nightlight, the apparatus comprising:

a circuit housing;

at least one battery contained within said circuit housing;

a plurality of solar panels disposed on an outside surface of said circuit housing for charging said at least one battery;

a plurality of LED lights;

control circuitry connecting said at least one battery, said solar panels and said plurality of LED lights to control operations of said LED lights and charging of said at least one battery;

a photocell operative to detect ambient light, said photocell being connected to said control circuitry where when ambient light falls below a predetermined level, said control circuitry activates said plurality of LED lights;

a plurality of translucent lenses each comprising a generally wedge shape, a bore hole in a base of said wedge shape for receiving a one of said plurality of LED lights and reflective material on outside edges of said wedge shape to direct and contain light;

a plurality of suction cups joined to at least said circuit housing for retaining the apparatus on a window surface where, during day light hours, there is sufficient ambient light to charge said at least one battery and said plurality of translucent lenses capture and reflect sunlight, and, during night hours, said translucent lenses illuminate a desired area; and a flexible conduit for joining said plurality of translucent lenses to said circuit housing where wires from said control circuitry to said plurality of LED lights pass through.

2. The apparatus as recited in claim 1, wherein said flexible conduit can be shaped, bent and adjusted to direct illumination from said plurality of translucent lenses.

3. The apparatus as recited in claim 2, wherein said flexible conduit has a sufficient length to extend from said window surface through blinds or shutters.

4. The apparatus as recited in claim 1, further comprising a transparent film comprising a print design, said transparent film joined to a surface of at least one of said plurality of translucent lenses where said print design is illuminated by said captured and reflected sunlight and by said at least one of said plurality of LED lights.

5. The apparatus as recited in claim 1, further comprising a brightness control for adjusting a brightness of said plurality of LED lights.

6. The apparatus as recited in claim 5, further comprising a speed control for adjusting a rotation of said plurality of LED lights from slow sparkle to solid lights.

7. An apparatus for a solar window nightlight, the apparatus comprising:

means for housing at least one battery and control circuitry;

means for charging said at least one battery;

a light producing means means for producing light from said at least one battery and said light producing means;

means for detecting a level of ambient light to activate said light producing means;

means for lensing light from said light producing means;

means for joining the apparatus to a window surface; and a flexible conduit for joining said means for lensing to said means for producing light where said light producing means pass through.

8. The apparatus as recited in claim 7, further comprising means for directing illumination from said lensing means.

9. The apparatus as recited in claim 7, further comprising means for illuminating a print design.

10. The apparatus as recited in claim 7, further comprising means for controlling a brightness of said light producing means.

11. The apparatus as recited in claim 10, further comprising means for adjusting a rotation of said light producing means.

12. An apparatus for a solar window nightlight, the apparatus comprising:

a circuit housing;

at least one battery contained within said circuit housing;

at least one solar panel disposed on an outside surface of said circuit housing for charging said at least one battery;

at least one light;

control circuitry connecting said at least one battery, said at least one solar panel and said at least one light to control operations of said at least one light and charging of said at least one battery;

a photocell operative to detect ambient light, said photocell being connected to said control circuitry where when ambient light falls below a predetermined level, said control circuitry activates said at least one light;

at least one translucent lens comprising a bore hole for receiving said at least one light;

means for retaining the apparatus on a generally flat vertical surface where, during day light hours, there is sufficient ambient light to charge said at least one battery, and, during night hours, said translucent lens illuminates a desired area; and a flexible conduit for joining said at least one translucent lens to said circuit housing where wires from said control circuitry to said at least one light pass through.

13. The apparatus as recited in claim 12, wherein said at least one translucent lens further comprises a generally wedge or cube shape and reflective material on outside edges to direct and contain light.

14. The apparatus as recited in claim 12, wherein said flexible conduit can be shaped, bent and adjusted to direct illumination from said at least one translucent lens.

15. The apparatus as recited in claim 14, wherein said conduit has a sufficient length to extend from said window surface through blinds or shutters.

16. The apparatus as recited in claim 12, further comprising a transparent film comprising a print design joined to a surface of said at least one translucent lens where said print design is illuminated by said at least one light.

17. The apparatus as recited in claim 12, further comprising a brightness control for adjusting a brightness of said at least one light.

18. The apparatus as recited in claim 17, further comprising a speed control for adjusting a flashing of said at least one light.

* * * * *